United States Patent [19]

Preuss

[11] Patent Number: 4,989,126

[45] Date of Patent: Jan. 29, 1991

[54] ILLUMINATED OUTDOOR ADVERTISING INSTALLATION

[75] Inventor: Werner Preuss, Leverkusen, Fed. Rep. of Germany

[73] Assignee: Agfa-Gevaert Aktiengessellschaft, Leverkusen, Fed. Rep. of Germany

[21] Appl. No.: 422,959

[22] Filed: Oct. 18, 1989

Related U.S. Application Data

[63] Continuation-in-part of Ser. No. 205,820, Jun. 13, 1988, abandoned.

[51] Int. Cl.[5] ..... G09F 13/04

[52] U.S. Cl. ..... 362/351; 362/812; 40/564

[58] Field of Search ..... 362/263, 351, 354, 812; 40/452, 541, 564, 572, 580

[56] References Cited

U.S. PATENT DOCUMENTS

| | | | |
|---|---|---|---|
| 1,705,422 | 3/1929 | Seward et al. | 40/541 |
| 2,608,013 | 8/1952 | Marsala | 362/812 |
| 3,390,259 | 6/1968 | Angier | 362/812 |
| 4,240,220 | 12/1980 | Smith | 40/580 |
| 4,807,092 | 2/1989 | Hasegawa | 362/812 |
| 4,891,896 | 1/1990 | Bozen | 40/580 |

FOREIGN PATENT DOCUMENTS

| | | | |
|---|---|---|---|
| 0041390 | 6/1981 | European Pat. Off. | 362/812 |

*Primary Examiner*—Ira S. Lazarus
*Assistant Examiner*—Richard R. Cole
*Attorney, Agent, or Firm*—Connolly & Hutz

[57] ABSTRACT

To produce outdoor advertising installations which are equipped to be illuminated and have different areas appearing, respectively, dark and light by daylight, with the brightness of the different areas being reversed by night under the influence of artificial light acting from the back, areas which appear bright by daylight on the outermost plate (information plate) are back printed with a bright covering and behind that with a dark covering and areas which appear dark by daylight are back printed dark with a regular pattern of lines or points.

10 Claims, 1 Drawing Sheet

ILLUMINATED OUTDOOR ADVERTISING INSTALLATION

This is a continuation-in-part of Ser. No. 07/205,820 filed 6/13/88 which is now abandoned.

This invention relates to an outdoor advertising installation equipped to be illuminated, having different areas appearing, respectively, dark and light by daylight, the brightness of the different areas being reversed by night under the influence of artificial light acting from the back so that areas which appear dark by daylight are bright by night and areas which are bright by daylight appear dark by night, consisting of a box containing neon lamps, a scattering plate arranged in front of the neon lamps and, in front of the scattering plate, another plate carrying the information to be displayed (information plate).

BACKGROUND OF THE INVENTION

Outdoor advertising installations of the type described above have hitherto only been known in the form of neon high voltage installations (single letters, continuous writing, individual signs, in which the lamp had the shape of the luminous element), in which the outermost plate was back printed grey so that it appeared darker by daylight and appeared brighter by night due to artificial light acting from the back. The overall impression is unsatisfactory because the colors white and black cannot be achieved and bright/dark reversal from day to night does not succeed.

It has surprisingly been found that outdoor advertising installations of the type defined above may be produced by covering the areas of the information plate which appear bright by daylight with a bright back printing and behind that with a dark back printing and covering areas of the information plate which appear dark by daylight with regular pattern of dark lines or dark points. The points and lines can be of any shape, preferably regular shape. Circular points are preferred.

The lines and points may be colored, e.g. dark and bright blue but they are preferably black and white.

Other preferred embodiments are the following: An additional bright or white back printing is applied to the dark printing with removal of that part of the area which has been covered with regular pattern of lines and points.

The points or lines have a covering of 20 to 90%, preferably of 40 to 80%. In consequence, the interspace between the lines or points has a covering of from 10 to 80%, preferably of from 20 to 60%. The information plate is arranged at a distance of 1 to 100 mm in front of the scattering plate.

Further, one or some or all of the back printings are duplicated or multiplicated, and there are two or more information plates and a corresponding number of scattering plates.

The information plates contain additional items of information which have the same apparent brightness and color both by day and by night.

The additional back printing in bright or white ensures by its reflection combined with the effect of the scattering plate, which is preferably a translucent glass plate, that the quantity of light will be better utilized. The preferred distance between the scattering plate and the information plate also contributes to this effect.

The construction of the illuminated advertising installation as a box with neon lamps, scattering plate and information plate is in accordance with conventional practice. The material used for the scattering plate and the information plate is glass or artificial glass, for example of polymethyl methacrylate or polycarbonate. Very fast pigmented printing inks are preferably used for the printing.

Outdoor advertising installations according to the invention having more than one information plate and the corresponding number of scattering plates may carry different items of information on the various information plates and may be constructed, for example, in the form of rectangular prisms with a front and back surface or as cubes with four information plates, and they may be rotatable.

If the information plates in addition have areas which appear to have the same degree of brightness and the same color by day and by night, these areas of the information plate are produced in known manner by simple back printing in the required colour and brightness.

BRIEF DESCRIPTION OF THE DRAWINGS

This invention is illustrated in the accompanying FIGS. 1 and 2, in which.

DESCRIPTION OF PREFERRED EMBODIMENTS

Figure 1:
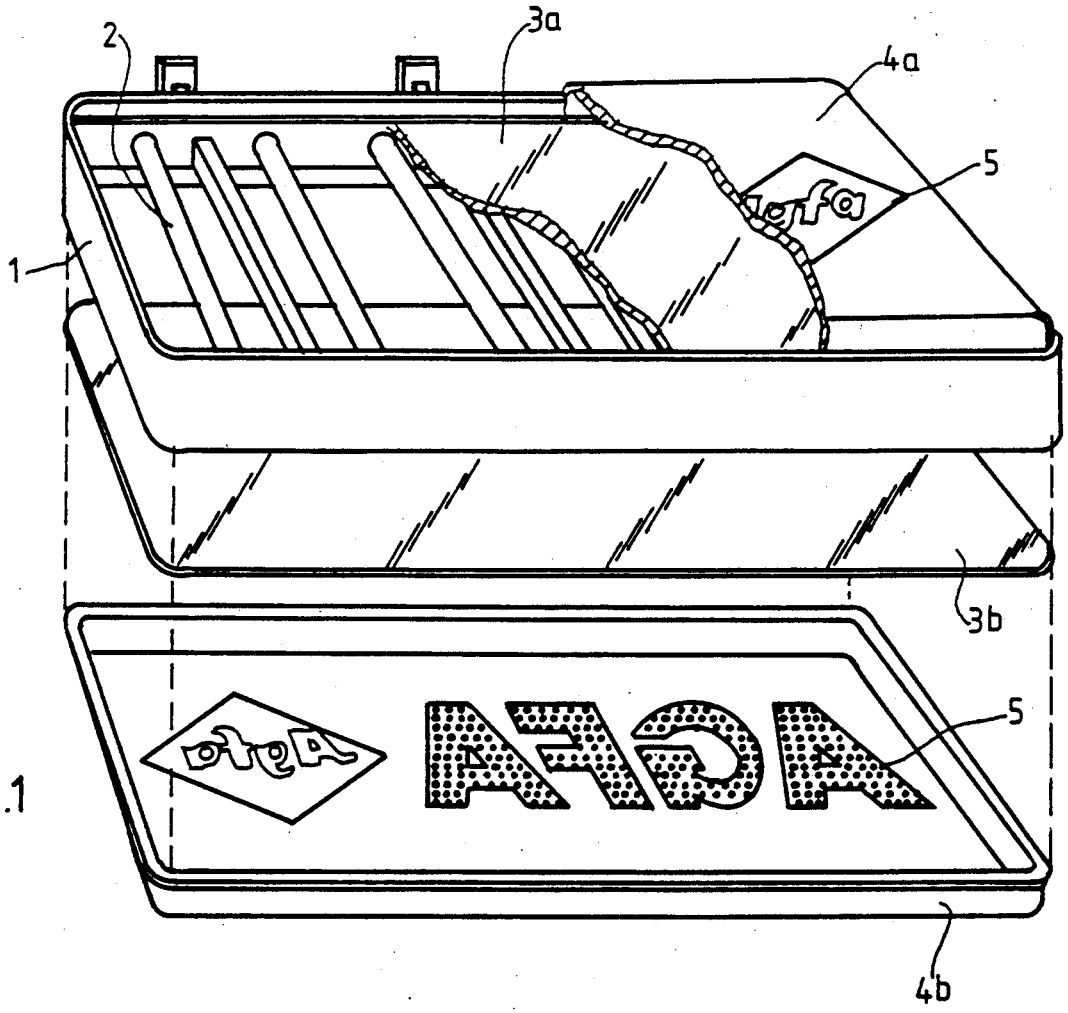
FIG. 1 is an expanded perspective view partly in section of an embodiment of the invention.

FIG. 1 shows a display device 10 according to this invention in expanded form partly in section. The device 10 is comprised of a rectangular box 1 which contains a plurality of neon lamps 2, an upper scattering plate **3*a*, partly in section, positioned in the box 1 and a lower scattering plate 3*b* spaced away in the expanded showing. An upper information plate 4*a* partly in section, is shown positioned on the box in front of the scattering plate layer 3 and and arranged at a distance from the upper scattering plate 3*a*. A lower information plate 4*b* is shown below and spaced away from the lower scattering plate 3*b* and the box 1** in the expanded showing.

The information plates **4*a* and 4*b* have areas of information 5*a* and 5*b* respectively provided by dark back printing. The information plates 4*a* and 4*b*** have bright back printing and dark back printing. In the embodiment as represented in the FIG. 1 the dark back printing is shown only in the areas of the printed pattern to provide an illustration of this feature of the invention.

Figure 2:
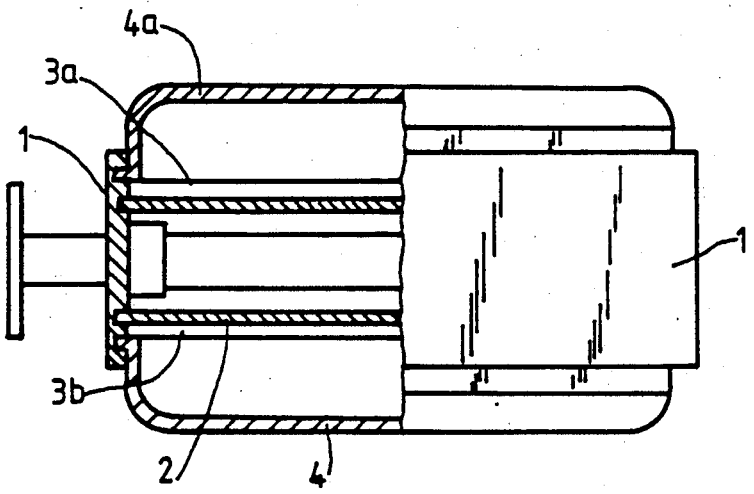
FIG. 2 is a side elevational view partly in section.

FIG. 2 shows the assembled device 10 illustrating plates **3*a* and 3*b* in relation to the respective information plates 4*a* and 4*b* as mounted in the box 1. FIG. 2 shows the final assembly of device 10 with the lower scattering plate 3*b* and the lower information plate 4*b* positioned and arranged with respect to box 1 the same as shown with upper scattering plate 3*a* and upper information plate 4*a***.

The display device 10 depicted in FIGS. 1 and 2 is adapted to be equipped for illumination and as shown in FIG. 1 the device 10 has areas of information **5*a* and 5*b* which appear respectively dark by daylight and bright by night under the influence of artificial light from neon lamps 2 in the device 10. Scattering plates 3*a* and 3*b* are provided in the box 1 with information plates 4*a* and 4*b* providing front and back surfaces to the assembled display device 10. The areas of information 5*a* and 5*b* which appear dark by daylight are covered with a dark back printing of a regular pattern of lines or points as shown at area of information 5b** in the FIG. 1.

What is claimed:

1. Outdoor advertising installation equipped to be illuminated, having different areas which appear, respectively, dark and light by daylight, the brightness of these areas being reversed by night under the influence of artificial light acting from the back so that areas which appear dark by daylight appear bright by night and areas which appear bright by daylight appear dark by night, consisting of a box containing neon lamps, a scattering plate arranged in front of the neon lamps and a plate carrying the information to be displayed (information plate) in front of the scattering plate, characterised in that areas which appear bright by daylight on the information plate are covered with bright back printing and then with dark back printing and areas which appear dark by daylight are covered with a dark back printing of a regular pattern of lines or points.

2. Outdoor advertising installation equipped to be illuminated according to claim 1, characterised in that the pattern is a pattern of circular points.

3. Outdoor advertising installation equipped to be illuminated according to claim 1, characteas which appear dark appear black and areas which appear bright appear white.

4. Outdoor advertising installation equipped to be illuminated according to claim 1, characterised in that the covering dark back printing and the dark back printing of the regular pattern are carried out simultaneously.

5. Outdoor adverising installation equipped to be illuminated according to claim 1, characterised in that an additional bright or white back printing is applied to the dark back printing with removal of that part of the area which has been covered with regular pattern of lines or points.

6. Outdoor advertising installation equipped to be illuminated according to claim 1, characterised in that the lines and points area has a 20 to 90% covering.

7. Illuminated outdoor advertising installation according to claim 1, characterised in that the information plate is arranged at a distance of 1 to 100 mm in front of the scattering plate.

8. Outdoor adverti 8. Outdoor advertising installation equipped to be illuminated according to claim 1, characterised in that one or some or all of the back printings are duplicated or multiplicated.

9. Outdoor advertising installation equipped to be illuminated according to claim 1, characterised in that it has two or more information plates and a corresponding number of scattering plates.

10. Outdoor advertising installation equipped to be illuminated according to claim 1, characterised in that the information plates contain additional items of information which have the same apparent brightness and colour both by day and by night.

* * * * *